US005243271A

United States Patent [19]

Lommers

[11] Patent Number: 5,243,271

[45] Date of Patent: Sep. 7, 1993

[54] VOLTAGE STABILIZED POWER SUPPLY WITH CAPACITOR ISOLATION DURING SUPPLY VOLTAGE VARIATIONS

[75] Inventor: Anthonius J. J. C. Lommers, Nijmegen, Netherlands

[73] Assignee: U.S. Philips Corporation, New York, N.Y.

[21] Appl. No.: 804,267

[22] Filed: Dec. 5, 1991

[30] Foreign Application Priority Data

Dec. 11, 1990 [NL] Netherlands ..... 9002716

[51] Int. Cl.[5] ..... G05F 1/56

[52] U.S. Cl. ..... 323/279; 323/274; 323/281; 323/313

[58] Field of Search ..... 323/313, 281, 273, 274, 323/314, 315, 284, 299, 288, 279

[56] References Cited

U.S. PATENT DOCUMENTS

| | | | |
|---|---|---|---|
| 4,555,660 | 11/1985 | von Winicki | 323/224 |
| 4,658,205 | 4/1987 | Yamada | 323/313 |
| 4,667,145 | 5/1987 | Moreau | 323/275 |
| 4,731,574 | 3/1988 | Melbert | 323/275 |
| 4,801,860 | 1/1989 | Murari et al. | 323/274 |
| 5,030,903 | 7/1991 | Bernard et al. | 323/313 |

*Primary Examiner*—Steven L. Stephan
*Assistant Examiner*—Adolf Berhane
*Attorney, Agent, or Firm*—Bernard Franzblau

[57] ABSTRACT

A power-supply arrangement comprises a reference circuit for generating a reference voltage (Vref). The reference circuit is coupled between a first (1) and a second (2) supply voltage terminal for receiving a supply voltage. A stabilizing circuit (4) generates a stabilization voltage (Vstab) related to the reference voltage and has an input terminal for receiving the reference voltage, a common terminal (7), and an output terminal for supplying the stabilization voltage. A switching stage (10) is switched depending on the supply voltage and comprises at least one switching element coupled between the input terminal and the common terminal. A current source is switched depending on the supply voltage and is coupled between the second supply voltage terminal and the common terminal. A capacitor is coupled between the common terminal and the first supply voltage terminal, and a buffer stage is coupled between the common terminal and the output terminal.

21 Claims, 2 Drawing Sheets

VOLTAGE STABILIZED POWER SUPPLY WITH CAPACITOR ISOLATION DURING SUPPLY VOLTAGE VARIATIONS

BACKGROUND OF THE INVENTION

This invention relates to a power-supply arrangement comprising a reference circuit for generating a reference voltage, which reference circuit has a reference terminal for supplying the reference voltage, the reference circuit being coupled between a first and a second supply voltage terminal for receiving a supply voltage, and a stabilising circuit for generating a stabilisation voltage related to the reference voltage. The stabilising circuit has an input terminal, coupled to the reference terminal for receiving the reference voltage, a common terminal coupled to the input terminal, and an output terminal, coupled to the common terminal, for supplying the stabilisation voltage. The common terminal is coupled to the first supply voltage terminal by means of a capacitor.

Such a power-supply arrangement can be used, inter alia, in integrated semiconductor circuits for supplying a stabilisation voltage to parts of a semiconductor circuit, such as, for example, amplifier circuits, the term "stabilisation voltage" being understood to mean a voltage which is stabilised at least relative to the supply voltage.

Such a power-supply arrangement is generally known. Since in many power-supply circuits the reference voltage generated by the reference circuit is subject to supply voltage variations, such power-supply arrangements comprise a stabilising circuit coupled to the reference circuit in order to stabilise the reference voltage. During supply voltage variations the stabilising circuit, which includes the capacitor, causes the stabilisation voltage, which is related to the reference voltage, to be generated, the stabilisation voltage being stabilised relative to the supply voltage in the absence of leakage currents which discharge the capacitor.

However, in practice such a power-supply arrangement is affected by leakage currents causing the capacitor to be discharged, as a result of which the voltage across the capacitor and hence the stabilisation voltage will vary dependent upon supply voltage variations.

SUMMARY OF THE INVENTION

It is an object of the invention to provide a power-supply arrangement which mitigates the adverse effects of said leakage currents which discharge the capacitor and which consequently generates a more stable stabilisation voltage.

A power-supply arrangement according to the invention is characterised in that the stabilising circuit further comprises a switching stage which is switched in dependence upon the supply voltage and which comprises at least one switching element coupled between the input terminal and the common terminal, and a buffer stage coupled between the common terminal and the output terminal. The invention is based on the recognition of the fact that said leakage currents flow via the reference circuit and also via a load coupled to the output terminal. Depending upon the supply voltage, leakage currents via the reference circuit are interrupted by means of the switching stage comprising the switching element, for which purpose the reference circuit and the capacitor are disconnected. In order to reduce leakage currents via the load, the stabilising circuit comprises a buffer stage requiring only a comparatively small current for generating the stabilisation voltage related to the reference voltage. Thus, the power-supply arrangement in accordance with the invention makes it possible to substantially reduce leakage currents capable of discharging the capacitor, resulting in an improved stability of the stabilisation voltage.

A first embodiment of a power-supply arrangement in accordance with the invention may be characterised in that the stabilising circuit further comprises a switchable current source which is switched dependent upon the supply voltage and which is coupled between the second supply voltage terminal and the common terminal. As a result of the addition of the switched current source the capacitor need not be charged by means of the reference circuit and, during supply voltage variations, the current source and the capacitor are disconnected to preclude an undesirable further charge supply.

A second embodiment of a power-supply arrangement in accordance with the invention may be characterised in that the stabilising circuit further comprises a driver circuit for driving the switching stage and the switched current source in dependence upon the supply voltage. By means of the driver stage supply voltage variations are converted into a control for the switching stage comprising the switching element and for the switched current source. In the absence of said variations the driver stage provides, for example, a direct coupling between the reference voltage and the capacitor, the switched current source ensuring a rapid charge supply to the capacitor, whereas in the case of variations the coupling thus established is interrupted and the switched current source is turned off.

A third embodiment of a power-supply arrangement in accordance with the invention, in which the reference circuit comprises at least one impedance coupled between the reference terminal and the first supply voltage terminal, may be characterised in that the switching stage further comprises a further switchable current source which is switched depending upon the supply voltage and which is coupled between the second supply voltage terminal and the input terminal, the switching element being constructed as a transistor having a base coupled to the input terminal, having a collector coupled to the first supply voltage terminal, and having an emitter coupled to the common terminal. In the present embodiment a current appearing in the further switched current source flows to the first supply voltage terminal through the impedance via the reference terminal, causing the reference voltage to increase. This increase causes a voltage appearing across the base and the emitter of the transistor to decrease, which decrease results in the transistor being cut off. Consequently, the direct coupling between the reference voltage and the capacitor is interrupted.

A fourth embodiment of a power-supply arrangement in accordance with the invention may be characterised in that the driver stage comprises a differential pair, which differential pair has a first input coupled to a terminal for receiving a measure of the supply voltage, a second input coupled to the output terminal, a first output adapted to drive the switched current source, and a second output adapted to drive the further switched current source. In this embodiment the differential pair compares the measure of the supply voltage with the stabilisation voltage available on the output terminal. If the measure exceeds the stabilisation voltage the differential pair activates the switched current source via the first output, the further switched current source coupled to the second output being disabled and consequently supplying no current. The switching element constituted by the transistor is therefore conductive and the capacitor receives a voltage related to the reference voltage, the appropriate charge being applied by the switched current source. If the supply voltage varies and the measure becomes smaller than the stabilisation voltage, the differential pair will activate the further switched current source at a given instant via the second output, the other switched current source being disabled. Thus, the direct coupling between the reference voltage and the capacitor is interrupted and the stabilisation voltage is derived from the voltage appearing across the capacitor.

A fifth embodiment of a power-supply arrangement in accordance with the invention may be characterised in that the first output is coupled to an input of a current mirror, the switched current source being an output of said current mirror and in that the second output is coupled to an input of a further current mirror, the further switched current source being an output of said further current mirror. The switched current sources can be implemented comparatively easily by means of the current mirrors. Depending on the supply voltage the differential pair selects the first or the second output, a current via the selected output directly resulting in a current to be supplied by the associated current source.

A sixth embodiment of a power-supply arrangement in accordance with the invention may be characterised in that the buffer stage comprises a transistor having a base coupled to the common terminal, having a collector coupled to the second supply voltage terminal, and having an emitter coupled to the output terminal. The transistor constitutes a simple implementation of the buffer stage, a comparatively small current via the base of the transistor resulting in a current via the emitter of the transistor, which last-mentioned current is required for generating the stabilisation voltage. Moreover, the buffer stage implemented by means of the transistor compensates for the voltage superposed on the reference voltage as a result of the switching element formed by means of the transistor.

BRIEF DESCRIPTION OF THE DRAWINGS

The above and other (more elaborate) features of the invention will now be described and explained in more detail with reference to the accompanying drawings, in which.

In these Figures like parts bear the same reference numerals.

DESCRIPTION OF THE PREFERRED EMBODIMENTS

Figure 1:
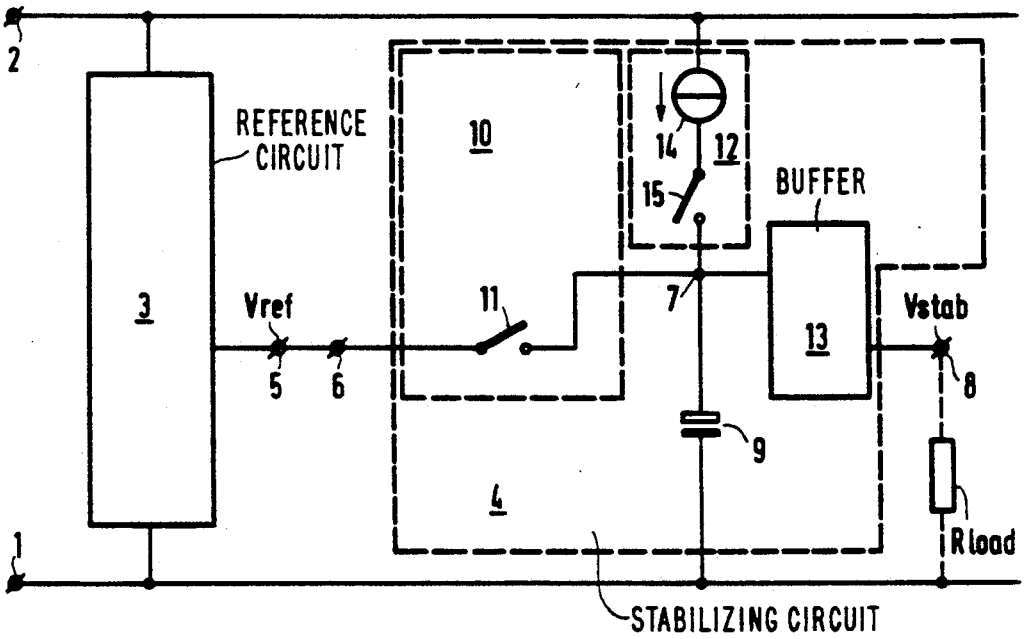
FIG. 1 is a basic diagram of a power-supply arrangement in accordance with the invention.

FIG. 1 shows a basic diagram of a power-supply arrangement in accordance with the invention, the power-supply arrangement having a first supply voltage terminal 1 and a second supply voltage terminal 2 for receiving a supply voltage. The power-supply arrangement comprises a reference circuit 3 for generating a reference voltage Vref, which reference circuit 3 is coupled between the supply voltage terminals 1 and 2, and a stabilising circuit 4 for generating a stabilisation voltage Vstab related to the reference voltage Vref. The reference circuit 3 comprises a reference terminal 5 at which the reference voltage Vref is available, and the stabilising circuit 4 comprises an input terminal 6, coupled to the reference terminal 5, for receiving the reference voltage Vref, a common terminal 7 coupled to the input terminal 6, and an output terminal 8, coupled to the common terminal 7, for supplying the stabilisation voltage Vstab. The stabilising circuit 4 further comprises a capacitor 9 coupled between the common terminal 7 and the supply voltage terminal 1, a switching stage 10 having a switching element 11 coupled between the input terminal 6 and the common terminal 7, a switched current source 12 coupled between the supply voltage terminal 2 and the common terminal 7, and a buffer stage 13 coupled between the common terminal 7 and the output terminal 8. The switched current source 12 is represented by a current source 14 and a switching element 15. Moreover, a load in the form of a resistive element Rload is shown between the output terminal 8 and the supply voltage terminal 1. In the absence of supply voltage variations the switching elements 11 and 15 are conductive, as a result of which a voltage equal to the reference voltage Vref appears across the capacitor 9, the current source 14 providing a rapid charge supply. Alternatively, depending on the construction of the switching element 11, the capacitor 9 may be charged by the reference circuit 3 so that the current source 14 is not essential. By means of the buffer stage 13 the stabilisation voltage Vstab is derived from the reference voltage Vref, the buffer stage 13 requiring only a small current. In the case of variations of the supply voltage the switching elements are cut off. As a result of this, the voltage across the capacitor 9 is independent of the influence of supply voltage variations on the reference voltage Vref and the charge supply by the current source 14 has terminated. The stabilisation voltage Vstab is derived from the voltage across the capacitor 9 via the buffer stage 13, the buffer stage 13 requiring only a small current. Consequently, the voltage on the capacitor 9 is sustained for a comparatively long time.

Figure 2:
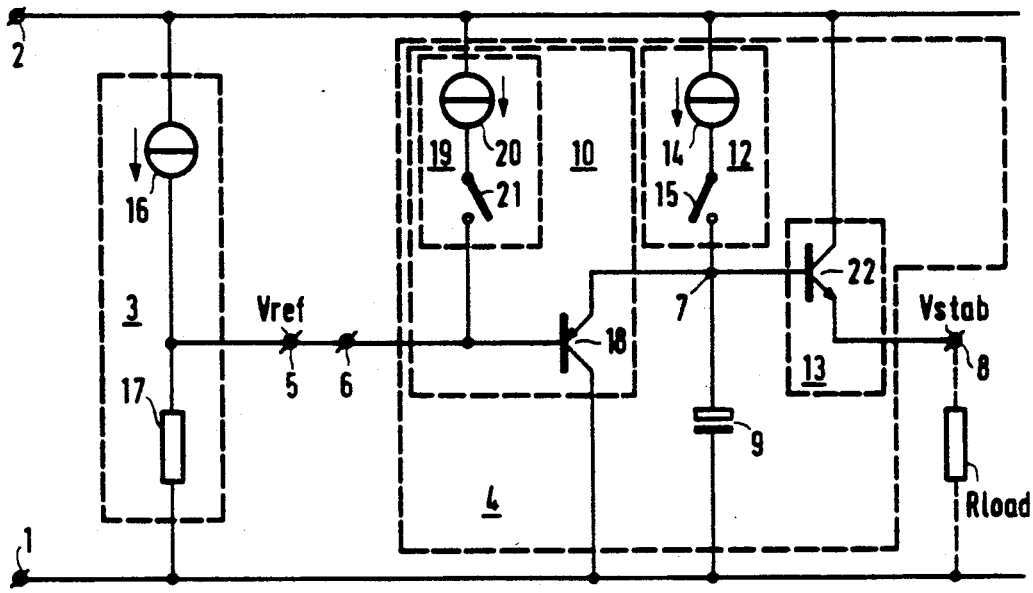
FIG. 2 shows an embodiment of a power-supply arrangement in accordance with the invention.

FIG. 2 shows an embodiment of a power-supply arrangement in accordance with the invention. The reference circuit 3, the switching stage 10 and the buffer stage 13 are shown in greater detail than in FIG. 1. The reference circuit 3 comprises a current source 16, coupled between the supply voltage terminal 2 and the reference terminal 5, and an impedance in the form of a resistor 17, coupled between the reference terminal 5 and the supply voltage terminal 1. In the switching stage 10 the switching element 11 shown in FIG. 1 has been replaced by a transistor 18 having a base coupled to the input terminal 6, having a collector coupled to the supply voltage terminal 1, and having an emitter coupled to the common terminal. The switching stage 10 further comprises a further switched current source 19, which in the same way as the current source 12 is represented by a current source 20 and a switching element 21. The buffer stage 13 comprises a transistor 22 having a base coupled to the common terminal 7, having a collector coupled to the supply voltage terminal 2, and having an emitter coupled to the output terminal 8. Although the reference circuit 3 in FIG. 2 is represented by the current source 16 and the resistor 17 numerous other implementations are possible, the impedance constituted by the resistor 17 being essential in the case of the switching stage shown in FIG. 2. This is because in the case of supply voltage variation the current source 20 feeds a current to the impedance via the conductive switching element 21, as a result of which the reference voltage Vref increases and the voltage across the base and the emitter of the transistor 18 decreases, which decrease causes the transistor 18 to be cut off. In the present embodiment the switching elements 15 and 21 are in opposite states of conduction at the same instant. The transistor 22 forms a simple implementation of the buffer stage 13. The transistor 22 produces the stabilisation voltage Vstab with a small base current and dependent upon the voltage across the capacitor 9. Moreover, the transistor 22 compensates for the voltage across the base and the emitter of the transistor 18 which is superposed on the reference voltage Vref so that the stabilisation voltage Vstab is substantially equal to the reference voltage Vref. The transistor 22 also compensates for temperature influences as a result of the presence of the transistor 18.

Figure 3:
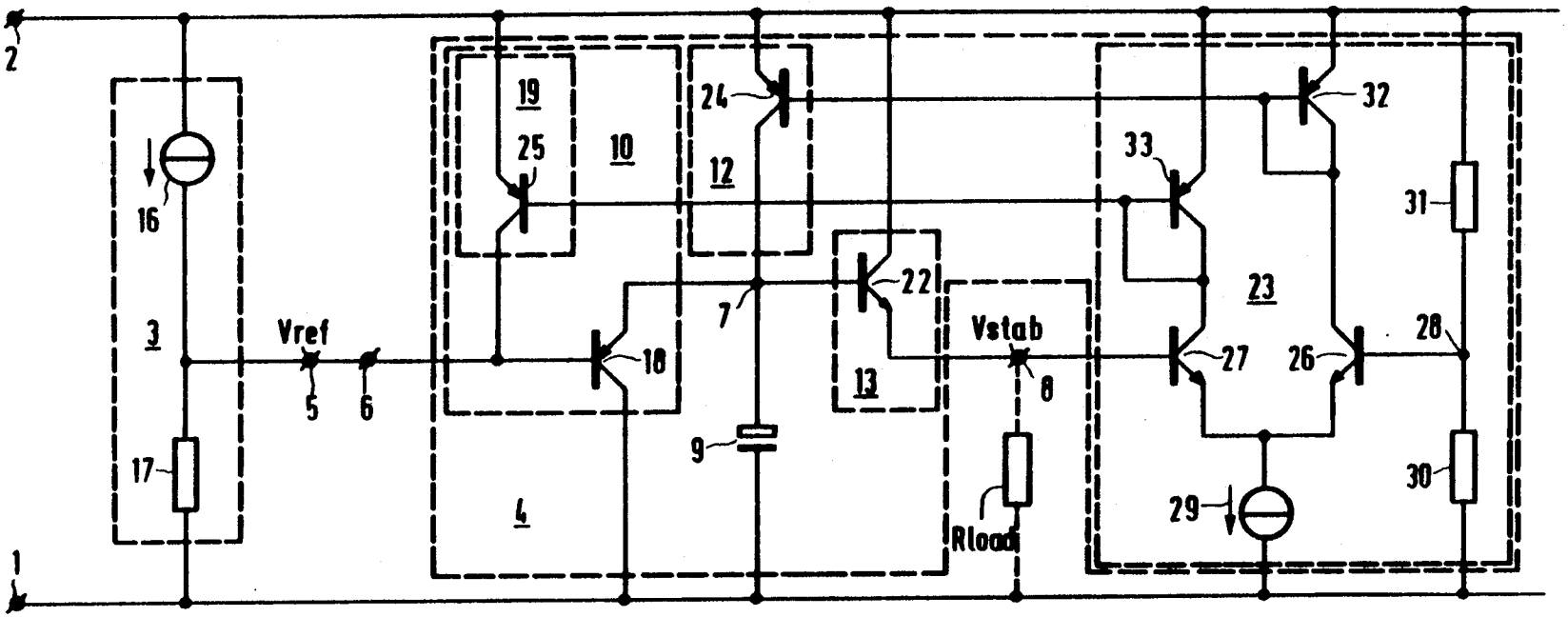
FIG. 3 shows a further embodiment of a power-supply arrangement in accordance with the invention.

FIG. 3 shows a further embodiment of a power-supply arrangement in accordance with the invention. The stabilising circuit 4 now further comprises a driver stage 23 for driving the switched current sources 12 and 19. Moreover, the switched current source 12 is constructed by means of a transistor 24 having a base coupled to the driver stage 23, having a collector coupled to the common terminal 7, and having an emitter coupled to the supply voltage terminal 2. The switched current source 19 is constructed by means of a transistor 25 having a base coupled to the driver stage 23, having a collector coupled to the input terminal 6, and having an emitter coupled to the supply voltage terminal 2. The driver stage 23 comprises a differential pair 26, 27 having a first input coupled to a terminal 28 for receiving a measure of the supply voltage, having a second input coupled to the output terminal 8, having a first output for driving the switched current source 12 implemented by means of the transistor 24, and having a second output for driving the switched current source 19 implemented by means of the transistor 25. The differential pair 26, 27 comprises a transistor 26 having a base forming the first input, having a collector forming the first output, and having an emitter, and a transistor 27 having a base forming the second input, having a collector forming the second output, and having an emitter. The emitters are coupled to one another and are coupled to the supply voltage terminal 1 by means of a tail current source 29. The measure of the supply voltage is obtained in that the terminal 28 is coupled to the supply voltage terminals 1 and 2 by means of a resistor 30 and a resistor 31, respectively. The transistors 24 and 25 form part of a current mirror 24, 32 and a further current mirror 25, 33 respectively for the purpose of driving the switched current sources 12 and 19, which current mirrors further comprise a diode-connected transistor 32 and a diode-connected transistor 33 respectively. The transistor 32 has a base coupled to the base of the transistor 24, a collector coupled both to the base of the transistor 32 and the collector of the transistor 26, and an emitter coupled to the supply voltage terminal 2. The transistor 33 has a base coupled to the base of the transistor 25, a collector coupled both to the base of the transistor 33 and to the collector of the transistor 27, and an emitter coupled to the supply voltage terminal 2.

With respect to the operation of the present embodiment, it will be evident that the resistors 30 and 31 constitute a voltage divider for deriving a measure of the supply voltage, which voltage divider can also be constructed in other ways. The voltage divider is dimensioned in such a manner that in the absence of supply voltage variations the measure is larger than the stabilisation voltage Vstab. Consequently, the transistors 26 and 27 will be conductive and cut off, respectively, so that a tail current in the tail current source 29 will flow through the transistor 26. Since said current is supplied by the transistor 32, which forms part of the current mirror 24, 32, the transistor 24 will carry a related current. Since the transistor 27 is cut off there will be no current in the current mirror 25, 33. As a consequence, a voltage related to the reference voltage Vref is applied across the capacitor 9 via the transistor 18, a rapid charge supply to the capacitor 9 being provided by the transistor 24. Said voltage results in the stabilisation voltage Vstab via the transistor 22. In the case of supply voltage variations the voltage divider is dimensioned in such a way that the measure becomes smaller than the stabilisation voltage Vstab. As a result of this, the transistors 26 and 27 are in a cut-off state and a conductive state respectively, so that the transistor 27 receives the current in the tail-current source from the current mirror 25, 33 and the transistor 25 is conductive. In this situation there is no current in the current mirror 24, 32. In the same way as in the power-supply arrangements shown in the preceding Figures, the capacitor 9 is isolated from the reference voltage Vref and the stabilisation voltage is generated on the basis of the voltage across the capacitor 9, which voltage remains substantially constant for a considerable time as a result of the buffer stage 13. Thus, the power-supply arrangement is stabilised with respect to supply voltage variations. If the supply voltage is furnished by one or more batteries, the present power-supply arrangement ensures that the batteries can be used for a longer time because it prevents the supply voltage from falling in the case of comparatively large supply currents.

The invention is not limited to the embodiments shown herein. Within the scope of the invention several modifications are conceivable to those skilled in the art. For example, the reference circuit can be constructed in many ways, special advantages being attainable when a temperature-stabilised reference voltage is generated. The stabilising circuit can also be constructed in many ways, in which case the buffer stage may comprise, for example, a plurality of transistors having mutually coupled bases, having mutually coupled collectors, and having separately coupled emitters each of which supply a stabilisation voltage to a respective load.

I claim:

1. A power-supply arrangement comprising a reference circuit for generating a reference voltage, said reference circuit having a reference terminal for supplying the reference voltage, the reference circuit being coupled between a first and a second supply voltage terminal for receiving a supply voltage, and a stabilising circuit for generating a stabilisation voltage related to the reference voltage which stabilising circuit has an input terminal, coupled to the reference terminal for receiving the reference voltage, a common terminal and an output terminal, for supplying the stabilisation voltage, the common terminal being coupled to the first supply voltage terminal by means of a capacitor, wherein the stabilising circuit further comprises a switching stage which is switched in dependence upon the supply voltage and which comprises at least one switching element coupled between the input terminal and the common terminal, and a buffer stage coupled between the common terminal and the output terminal.

2. A power-supply arrangement as claimed in claim 1, wherein the stabilising circuit further comprises a current source which is switched dependent upon the supply voltage and which is coupled between the second supply voltage terminal and the common terminal.

3. A power-supply arrangement as claimed in claim 2, wherein the stabilising circuit further comprises a driver circuit for driving the switching stage and the switched current source dependent upon the supply voltage.

4. A power-supply arrangement as claimed in claim 3, wherein the reference circuit comprises at least one impedance coupled between the reference terminal and the first supply voltage terminal, and the switching stage further comprises a further current source which is switched dependent upon the supply voltage and which is coupled between the second supply voltage terminal and the input terminal, the switching element comprising a transistor having a base coupled to the input terminal, having a collector coupled to the first supply voltage terminal, and having an emitter coupled to the common terminal.

5. A power-supply arrangement as claimed in claim 4, wherein the driver stage comprises a differential pair, having a first input coupled to a terminal for receiving a measure of the supply voltage, a second input coupled to the output terminal, a first output adapted to drive the switched current source, and a second output adapted to drive the further switched current source.

6. A power-supply arrangement as claimed in claim 5, wherein the first output of the differential pair is coupled to an input of a current mirror, the switched current source being an output of said current mirror.

7. A power-supply arrangement as claimed in claim 6, wherein the second output of the differential pair is coupled to an input of a further current mirror, the further switched current source being an output of said further current mirror.

8. A power-supply arrangement as claimed in claim 1, wherein the buffer stage comprises a transistor having a base coupled to the common terminal, having a collector coupled to the second supply voltage terminal, and having an emitter coupled to the output terminal.

9. A power-supply arrangement as claimed in claim 2, wherein the buffer stage comprises a transistor having a base coupled to the common terminal, having a collector coupled to the second supply voltage terminal, and having an emitter coupled to the output terminal.

10. A power-supply arrangement as claimed in claim 3, wherein the buffer stage comprises a transistor having a base coupled to the common terminal, having a collector coupled to the second supply voltage terminal, and having an emitter coupled to the output terminal.

11. A power-supply arrangement as claimed in claim 4, wherein the buffer stage comprises a transistor having a base coupled to the common terminal, having a collector coupled to the second supply voltage terminal, and having an emitter coupled to the output terminal.

12. A power-supply arrangement as claimed in claim 1 wherein the stabilizing circuit further comprises a switchable current source switchable as a function of the supply voltage and coupled between one of said supply voltage terminals and the capacitor.

13. A voltage stabilized power supply comprising:

first and second supply voltage terminals, a reference voltage circuit coupled between said first and second supply voltage terminals and having a reference terminal that produces a reference voltage, and a voltage stabilizing circuit for generating at its output terminal a stabilization voltage related to the reference voltage, said voltage stabilizing circuit having an input terminal coupled to the reference terminal, a common terminal coupled to the input terminal via a semiconductor switching element which is switched as a function of the supply voltage, a capacitor coupled between the common terminal and the first supply voltage terminal, and a semiconductor buffer stage coupled between the common terminal and the output terminal.

14. A voltage stabilized power supply as claimed in claim 13, wherein the voltage stabilizing circuit further comprises a switchable current source switchable as a function of the supply voltage and coupled between the second supply voltage terminal and the common terminal.

15. A voltage stabilized power supply as claimed in claim 14, wherein a given variation of the supply voltage from a nominal value opens said semiconductor element and said switchable current source thereby to isolate the capacitor from the current source and from the reference voltage.

16. A voltage stabilized power supply as claimed in claim 14, wherein the voltage stabilizing circuit further comprises a second switchable current source switchable as a function of the supply voltage and coupled between the second supply voltage terminal and the input terminal, said first switchable current source being closed when the second switchable current source is open and vice versa.

17. A voltage stabilized power supply as claimed in claim 13, wherein the semiconductor switching element is connected with its emitter/base circuit coupled between the common terminal and the input terminal, and said semiconductor buffer stage comprises an emitter follower transistor with its base/emitter circuit coupled between the common terminal and the output terminal whereby temperature compensation is provided by the emitter follower transistor and the semiconductor switching element.

18. A voltage stabilized power supply as claimed in claim 16, wherein the voltage stabilizing circuit further comprises a transistor differential amplifier driver stage having a first input which receives a voltage determined by the supply voltage, a second input coupled to the output terminal, and first and second outputs coupled to first and second current mirror circuits, respectively, which comprise parts of the first and second switchable current sources, respectively.

19. A voltage stabilized power supply as claimed in claim 16, wherein the reference voltage circuit comprises a further current source and at least one impedance element serially connected between the second and first supply voltage terminals and with a node therebetween connected to said reference terminal.

20. A voltage stabilized power supply as claimed in claim 13, wherein said voltage supply terminals are adapted to be connected to terminals of at least one electric battery.

21. A voltage stabilized power-supply as claimed in claim 13 further comprising a switching transistor switchable as a function of the supply voltage and coupled between the second supply voltage terminal and the common terminal so as to operate as a switchable current source for the capacitor.

* * * * *

UNITED STATES PATENT AND TRADEMARK OFFICE

CERTIFICATE OF CORRECTION

PATENT NO. : 5,243,271

DATED : September 7, 1993

INVENTOR(S) : Anthonius J.J.C. Lommers

It is certified that error appears in the above-identified patent and that said Letters Patent is hereby corrected as shown below:

IN THE CLAIMS

Col. 6, line 64, after "terminal" insert --,-- (comma).

Signed and Sealed this

Seventeenth Day of May, 1994

*Attest:*

*Attesting Officer*

BRUCE LEHMAN

*Commissioner of Patents and Trademarks*